US009068147B2

(12) United States Patent
Dobrawa et al.

(10) Patent No.: US 9,068,147 B2
(45) Date of Patent: Jun. 30, 2015

(54) QUATERNIZED POLYETHYLENIMINES WITH A HIGH QUATERNIZATION DEGREE

(71) Applicant: BASF SE, Ludwigshafen (DE)

(72) Inventors: Rainer Dobrawa, Ludwigshafen (DE); Sophia Ebert, Mannheim (DE); Stefano Scialla, Rome (IT); Frank Huelskoetter, Bad Dürkheim (DE); Gloria Di Capua, Ardea (IT); Patrick Delplancke, Strombeek-Bever (BE); Marc Evers, Strombeek-Bever (BE); Melissa Cuthbertson, Newcastle upon Tyne (GB); Glenn Ward, Newcastle upon Tyne (GB); Anju Brooker, Newcastle upon Tyne (GB); Phan Shean Lim, Newcastle upon Tyne (GB); Michael Stanford Showell, Strombeek-Bever (BE)

(73) Assignee: BASF SE, Ludwigshafen (DE)

( * ) Notice: Subject to any disclaimer, the term of this patent is extended or adjusted under 35 U.S.C. 154(b) by 75 days.

(21) Appl. No.: 13/890,409

(22) Filed: May 9, 2013

(65) Prior Publication Data

US 2013/0303725 A1 Nov. 14, 2013

Related U.S. Application Data

(60) Provisional application No. 61/645,650, filed on May 11, 2012.

(51) Int. Cl.

| | |
|---|---|
| ***C08G 73/04*** | (2006.01) |
| ***C11D 3/37*** | (2006.01) |
| ***D21H 17/34*** | (2006.01) |
| ***D21H 17/45*** | (2006.01) |
| ***D21H 17/56*** | (2006.01) |
| *C08G 73/00* | (2006.01) |

(52) U.S. Cl.

CPC ..... *C11D 3/3723* (2013.01); *D21H 17/34* (2013.01); *D21H 17/45* (2013.01); *D21H 17/455* (2013.01); *D21H 17/56* (2013.01)

(58) Field of Classification Search

CPC ..... C08G 73/04
USPC ..... 528/422, 425
See application file for complete search history.

(56) References Cited

U.S. PATENT DOCUMENTS

| | | | |
|---|---|---|---|
| 3,812,044 | A | 5/1974 | Connor et al. |
| 3,838,057 | A | 9/1974 | Barnes et al. |
| 3,907,701 | A | 9/1975 | Buettner et al. |
| 3,915,903 | A | 10/1975 | Wise |
| 4,076,497 | A | 2/1978 | Freyberg et al. |
| 4,246,612 | A | 1/1981 | Berry et al. |
| 4,663,071 | A | 5/1987 | Bush et al. |
| 4,810,410 | A | 3/1989 | Diakun et al. |
| 5,034,508 | A | 7/1991 | Nishizaki et al. |
| 5,114,611 | A | 5/1992 | Van Kralingen et al. |
| 5,227,084 | A | 7/1993 | Martens et al. |
| 5,565,145 | A | 10/1996 | Watson et al. |
| 6,008,181 | A | 12/1999 | Cripe et al. |
| 6,020,303 | A | 2/2000 | Cripe et al. |
| 6,060,443 | A | 5/2000 | Cripe et al. |
| 6,075,000 | A | 6/2000 | Rohrbaugh et al. |
| 6,127,331 | A | 10/2000 | Cleary et al. |
| 8,318,653 | B2 | 11/2012 | Misske et al. |
| 8,754,027 | B2 * | 6/2014 | Dobrawa et al. ..... 510/504 |
| 2006/0234895 | A1 | 10/2006 | Bittner et al. |
| 2007/0275868 | A1 | 11/2007 | Cooremans et al. |
| 2008/0153983 | A1 | 6/2008 | Bittner et al. |
| 2009/0176935 | A1 | 7/2009 | Boeckh et al. |
| 2009/0189086 | A1 | 7/2009 | Gessner et al. |
| 2009/0215662 | A1 | 8/2009 | Boeckh et al. |
| 2010/0011656 | A1 | 1/2010 | Gessner et al. |

FOREIGN PATENT DOCUMENTS

| | | | |
|---|---|---|---|
| DE | 2 227 546 | | 1/1974 |
| EP | 111965 | A2 | 6/1984 |
| EP | 0 359 034 | | 3/1990 |
| EP | 0458397 | A2 | 11/1991 |
| EP | 0458398 | A2 | 11/1991 |
| EP | 0957156 | A1 | 11/1999 |
| JP | 2003020585 | | 1/2003 |
| WO | WO-99/05082 | A1 | 2/1999 |
| WO | WO-99/05084 | A1 | 2/1999 |
| WO | WO-99/05241 | A1 | 2/1999 |
| WO | WO-99/05242 | A1 | 2/1999 |
| WO | WO-99/05243 | A1 | 2/1999 |

(Continued)

OTHER PUBLICATIONS

Parry; Nonaqueous liquid detergent—ethoxylated quaternized amine clay compounds; 1999; The Poroctor & Gamble Company; Chem Abstract 131: 33256.*

Murata et al; Dtergent compositions—chlorine scavengers; 1997; The Proctor & Gamble Company; Chem Abstract 128: 24314.*

Search report from European Patent Office for EP 12 16 7675 dated Aug. 28, 2012.

G. Scherr, "Imines, Cyclic" Kirk-Othmer Encyclopedia of Chemical Technology, Dec. 4, 2000 John Wiley & Sons.

U. Steuerle et al. "Aziridines" Ullmann's Encyclopedia of Industrial Chemistry, 2001, Wiley-VCH Verlag GmbH & Co., Weinheim.

*Primary Examiner* — Duc Truong

(74) *Attorney, Agent, or Firm* — Drinker Biddle & Reath LLP

(57) ABSTRACT

The present invention relates to an ethoxylated polyethyleneimine polymer consisting essentially of (a) a polyethyleneimine backbone, (b) a polyoxyethylene chain wherein the polyoxyethylene chain has an average of 1 to less than 40 ethyleneoxide units per unit of NH in the polyethyleneimine backbone, (3) a quaternization degree of from 50% to 100%.

5 Claims, No Drawings

(56) References Cited

FOREIGN PATENT DOCUMENTS

| | | | |
|---|---|---|---|
| WO | WO-99/05244 | A1 | 2/1999 |
| WO | WO-99/06521 | A1 | 2/1999 |
| WO | WO-99/07656 | A2 | 2/1999 |
| WO | WO-9967352 | | 12/1999 |
| WO | WO-00/23548 | A1 | 4/2000 |
| WO | WO-00/23549 | A1 | 4/2000 |
| WO | WO-2005063850 | A1 | 7/2005 |
| WO | WO-2006108856 | A1 | 10/2006 |
| WO | WO-2006108856 | A2 | 10/2006 |
| WO | WO-2006108857 | A1 | 10/2006 |
| WO | WO-2008146194 | A1 | 12/2008 |
| WO | WO-2009/060059 | A2 | 5/2009 |
| WO | WO-2010020765 | A1 | 2/2010 |
| WO | WO-2011051646 | A1 | 5/2011 |

* cited by examiner

QUATERNIZED POLYETHYLENIMINES WITH A HIGH QUATERNIZATION DEGREE

CROSS-REFERENCE TO RELATED APPLICATIONS

This application claims benefit (under 35 USC 119(e)) of U.S. Provisional Application 61/645,650, filed May 11, 2012, which is incorporated by reference.

BRIEF SUMMARY OF THE INVENTION

The present invention relates to an ethoxylated polyethylenimine polymer consisting essentially of (a) a polyethyleneimine backbone, (b) an ethoxylation modification consisting of the replacement of a hydrogen atom by a polyoxyethylene chain having an average of from 1 to 40 ethoxy units per unit of NH in the polyethyleneimine backbone, (3) a quaternization degree of the nitrogen atoms present in the polyethyleneimine backbone which lies in the range of from 50% to 100%.

BACKGROUND OF THE INVENTION

Surface cleaning with liquid detergents poses an ongoing problem for consumers. Consumers utilizing liquid detergents as a light-duty liquid dishwashing detergent composition or as a hard surface cleaning composition frequently find surface imperfections such as soil residues, streaks, film and/or spots after washing. Besides, consumers prefer cleaning compositions to be dried faster after the cleaning process. Hence, there remains a need for liquid cleaning compositions which not only clean hard surfaces, but also deliver improved shine and fast-drying.

At the same time, consumers using detergents in automatic dishwashing frequently find that items placed in a dishwasher to be washed are stained with different kinds of stains which are particularly difficult to remove, especially when it comes to tea and coffee stains. The problem is more acute when the detergent is phosphate free.

It is an object of the present invention to provide polymers which are suitable as an additive to cleaning compositions for hard surfaces and which deliver improved shine and fast-drying as well as an improved stain removal from hard surfaces.

The use of polyalkyleneimines in cleaning compositions is known. Traditionally, polyalkyleneimines have been used in laundry detergents to provide soil suspension benefits. Polyethyleneimines have also been used in hard surface cleaning compositions to provide different benefits. WO2011/051646 discloses a method of treating hard surfaces to improve soil resistance, particularly resistance to oily soils, which comprises applying to the surface a composition comprising a quaternised polyamine which has been block propoxylated and then block ethoxylated. WO2010/020765 discloses the use of a composition comprising a polyalkyleneimine and/or a salt or derivative thereof for the prevention of corrosion of non-metallic inorganic items during a washing or rinsing process.

US2007/0275868A1 reads on a liquid detergent composition comprising an alkoxylated polyethylenimine with one or two alkoxylation modification per nitrogen atom. The degree of permanent quaternization may be from 0% to 30% of the polyethyleneimine backbone nitrogen atoms. WO2006/108856 reads on an amphiphilic water-soluble alkoxylated polyalkyleneimines comprising ethylenoxy and propylenoxy units and having a degree of quaternization of up to 50% for use as additives for laundry detergents and cleaning compositions.

WO2009/060059 describes amphiphilic water-soluble alkoxylated polyalkyleneimines comprising ethylenoxy and propylenoxy units for use as additives for laundry detergents.

A DETAILED DESCRIPTION OF THE INVENTION

It has surprisingly been found that the polymers of the present invention are not only effective in cleaning surfaces, but also provide an improved shine benefit when used for light-duty dishwashing or for hard surface cleaning as well as an improved stain removal when used in automatic dishwashing.

Ethoxylated Polyethyleneimine Polymer

The ethoxylated polyethyleneimine of the present invention has the general structure of formula (I):

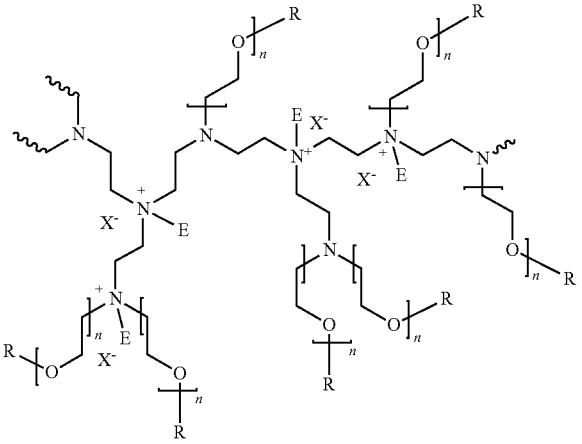

wherein n has a value which lies in the range of from 1 to 40, R is selected from hydrogen, a $C_1$-$C_4$ alkyl and mixtures thereof, E represents a $C_1$-$C_{12}$ alkyl unit, $X^-$ represents a suitable water soluble counterion and the degree of quaternization of the nitrogen atoms present in the polyethyleneimine backbone lies in the range of from 50% to 100%.

Quaternization is preferably achieved by reaction with dimethyl sulfate.

In a preferred embodiment the degree of quaternization of the nitrogen atoms present in the polyethyleneimine backbone lies in the range of from 60% to about 95%.

In another preferred embodiment the degree of quaternization of the nitrogen atoms present in the polyethyleneimine backbone lies in the range of from 70% to 90%.

The polymer of the present invention has a polyethyleneimine backbone having a weight average molecular weight from about 400 g/mol to about 10000 g/mol. In one embodiment, the weight average molecular weight is preferably from about 400 g/mol to about 6000 g/mol, more preferably from about 400 to about 1800 g/mol. Alternatively, in another embodiment, the polyethyleneimine backbone has from about 3000 to about 10000 g/mol, preferably from about 4000 to about 6000 g/mol, and most preferably about 5000 g/mol.

The modification of the polyethyleneimine backbone includes: (1) one or two ethoxylation modifications per nitrogen atom, dependent on whether the modification occurs at an internal nitrogen atom or at a terminal nitrogen atom in the polyethyleneimine backbone. The ethoxylation modification consists of the replacement of a hydrogen atom by a polyoxyethylene chain having an average of about 1 to about 40 ethoxy units per modification, preferably about 1 to about 30 ethoxy units, and more preferably about 3 to about 20 ethoxy units. The terminal ethoxy unit of the ethoxylation modification is capped with hydrogen, a $C_1$-$C_4$ alkyl or mixtures thereof. The ethoxy substitution level of the polyethyleneimine is between about 3 moles and about 20 moles of ethylene oxide per mole of NH, preferably 5-15, most preferably 6-10. (2) quaternization of a tertiary nitrogen atom, bearing 0, 1, or 2 polyoxyethylene chains. The quaternization is achieved preferably by introducing $C_1$-$C_{12}$ alkyl, aryl or alkylaryl groups and may be undertaken in a customary manner by reaction with corresponding alkyl-, alkylaryl-, halides and dialkylsulfates.

The degree of quaternization of the nitrogen atoms present in the polyethyleneimine backbone lies in the range of from 50% to 100%, preferably from 50% to 95%, most preferably from 70% to 90% of the polyethyleneimine backbone nitrogen atoms.

For example, but not limited to, below is shown possible modifications to terminal nitrogen atoms in the polyethyleneimine backbone where R represents an ethylene spacer and E represents a $C_1$-$C_{12}$ alkyl unit and $X^-$ represents a suitable water soluble counterion, such as chlorine, bromine or iodine, sulphate (i.e. —O—SO3H or —O—SO3-), alkylsulfonate such as methylsulfonate, arylsulfonate such as tolylsulfonate, and alkyl sulphate, such as methosulphate (i.e. —O—SO2-OMe)).

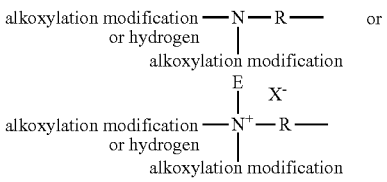

Also, for example, but not limited to, below is shown possible modifications to internal nitrogen atoms in the polyethyleneimine backbone where R represents an ethylene spacer and E represents a $C_1$-$C_{12}$ alkyl unit and $X^-$ represents a suitable water soluble counterion.

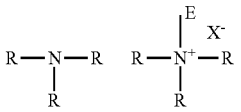

These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, as described in G. Scherr, U. Steuerle and R. Fikentscher: "Imines, Cyclic" in Kirk-Othmer Encyclopedia of Chemical Technology and U. Steuerle, R. Feuerhake: "Aziridines" in Ullmann's Encyclopedia of Industrial Chemistry.

The inventive alkoxylated polyalkylenimines may be prepared in a known manner by reaction of polyalkylene imines with ethylene oxides.

One preferred procedure consists in initially undertaking only an incipient ethoxylation of the polyalkylene imine in a first step. In this step, the polyalkylene imine is reacted only with a portion of the total amount of ethylene oxide used, which corresponds to about 1 mol of ethylene oxide per mole of NH unit. This reaction is undertaken generally in the absence of a catalyst in an aqueous solution at a reaction temperature from about 70 to about 200° C. and preferably from about 80 to about 160° C. This reaction may be affected at a pressure of up to about 10 bar, and in particular up to about 8 bar.

In a second step, the further ethoxylation is then effected by subsequent reaction with the remaining amount of ethylene oxide. The further ethoxylation is undertaken typically in the presence of a basic catalyst. Examples of suitable catalysts are alkali metal and alkaline earth metal hydroxides such as sodium hydroxide, potassium hydroxide and calcium hydroxide, alkali metal alkoxides, in particular sodium and potassium $C_1$-$C_4$-alkoxides, such as sodium methoxide, sodium ethoxide and potassium tert-butoxide, alkali metal and alkaline earth metal hydrides such as sodium hydride and calcium hydride, and alkali metal carbonates such as sodium carbonate and potassium carbonate. Preference is given to the alkali metal hydroxides and the alkali metal alkoxides, particular preference being given to potassium hydroxide and sodium hydroxide. Typical use amounts for the base are from 0.05 to 10% by weight, in particular from 0.5 to 2% by weight, based on the total amount of polyalkyleneimine and alkylene oxide.

The further ethoxylation may be undertaken in substance (variant a)) or in an organic solvent (variant b)). In variant a), the aqueous solution of the incipiently ethoxylated polyalkylenimine obtained in the first step, after addition of the catalyst, is initially dewatered. This can be done in a simple manner by heating to from about 80 to about 150° C. and distilling off the water under a reduced pressure of from about 0.01 to about 0.5 bar. The subsequent reaction with the ethylene oxide is effected typically at a reaction temperature from about 70 to about 200° C. and preferably from about 100 to about 180° C. The subsequent reaction with the alkylene oxide is effected typically at a pressure of up to about 10 bar and in particular up to 8 bar. The reaction time of the subsequent reaction with the ethylene oxide is generally about 0.5 to about 4 hours. Suitable organic solvents for variant b) are in particular nonpolar and polar aprotic organic solvents. Examples of particularly suitable nonpolar aprotic solvents include aliphatic and aromatic hydrocarbons such as hexane, cyclohexane, toluene and xylene. Examples of particularly suitable polar aprotic solvents are ethers, in particular cyclic ethers such as tetrahydrofuran and dioxane, N,N-dialkylamides such as dimethylformamide and dimethylacetamide, and N-alkyllactams such as N-methylpyrrolidone. It is of course also possible to use mixtures of these organic solvents. Preferred organic solvents are xylene and toluene.

In variant b), the solution obtained in the first step, after addition of catalyst and solvent, is initially dewatered, which is advantageously done by separating out the water at a temperature of from about 120 to about 180° C., preferably supported by a gentle nitrogen stream. The subsequent reaction with the alkylene oxide may be effected as in variant a). In variant a), the alkoxylated polyalkylenimine is obtained directly in substance and may be converted if desired to an aqueous solution. In variant b), the organic solvent is typically removed and replaced by water. The products may, of course, also be isolated in substance.

The quaternization of ethoxylated polyethyleneimines is achieved preferably by introducing C1-C12 alkyl, aryl or alkylaryl groups and may be undertaken in a customary manner by reaction with corresponding alkyl-, alkylaryl-, halides and dialkylsulfates, as described for example in WO2009060059.

The quaternization of ethoxylated polyethyleneimines is achieved preferably by reacting the amines with at least one alkylating compound, which is selected from the compounds of the formula EX, wherein E is C1-C12 alkyl, aryl or alkyl and X is a leaving group, which is capable of being replaced by nitrogen (and C2-C6 alkylene oxide, especially ethylene oxide or propylene oxide).

Suitable leaving groups X are halogen, especially chlorine, bromine or iodine, sulphate (i.e. —OSO3H or —OSO3-), alkylsulfonate such as methylsulfonate, arylsulfonate such as tolylsulfonate, and alkyl sulphate, such as methosulphate (i.e. —OSO2OMe). Preferred alkylating agents EX are C1-C12 alkyl halides, bis(C1-C12-alkyl)sulfates, and benzyl halides. Examples of such alkylating agents are ethyl chloride, ethyl bromide, methyl chloride, methyl bromide, benzyl chloride, dimethyl sulphate, diethyl sulphate.

The amount of alkylating agent determines the amount of quaternization of the amino groups in the polymer, i.e. the amount of quaternized moieties.

The amount of the quaternized moieties can be calculated from the difference of the amine number in the non-quaternized amine and the quaternized amine.

The amine number can be determined according to the method described in DIN 16945.

The reaction can be carried out without any solvent, However, a solvent or diluent like water, acetonitrile, dimethylsulfoxide, N-Methylpyrrolidone, etc. may be used. The reaction temperature is usually in the range from 10° C. to 150° C. and is preferably from 50° C. to 110° C.

For the purpose of the present invention, "consisting essentially of" is to be understood in the sense that the copolymer according to the invention might contain a certain amount of impurities or other alkyleneoxide units other than ethylene oxide. Thus the inventive polymer might contain up to 2 alkylenoxide units other than ethylene oxide per mol of NH in the polyethyleneimine backbone, such as propylene oxide or butylene oxide.

Compositions Comprising the Ethoxylated Polyethyleneimine Polymer According to the Invention The ethoxylated polyethyleneimine polymer according to the invention may be comprised in an amount of from 0.001 to 10% by weight, more preferably from 0.01 wt % to 1.5 wt % and most preferably from 0.05% to 1.0% by weight in a hard surface cleaning detergent composition, a hand dishwashing detergent composition or an automatic dishwashing detergent composition.

The composition comprising the ethoxylated polyethyleneimine polymer according to the invention may be in a form selected from the group consisting of a liquid, a gel, and a solid.

The ethoxylated polyethyleneimine polymer according to the invention may also be comprised in chemical technical applications, car wash, cosmetics, paper and cardboard manufacturing, leather and textile industry.

In a preferred embodiment, the hard surface cleaning composition comprising the ethoxylated polyalkylenimine polymer according to the invention is used to provide fast drying and/or to deliver shine on household hard surfaces. In an alternatively preferred embodiment, the hand dishwashing detergent composition comprising the polymer according to the invention is used to provide fast drying and/or to deliver shine on dishes, flatware, glassware, cutlery, etc. in a hand dishwashing cleaning operation. In another preferred embodiment, the automatic dishwashing composition comprising the polymer according to the invention is used to provide fast drying and/or to deliver shine on dishes, flatware, glassware, cutlery, etc. in an automatic dishwashing operation and/or for the removal of bleachable stains, preferably tea and coffee stains, from cookware/tableware in automatic dishwashing.

In one preferred embodiment, the composition is a hard surface cleaning composition, the composition comprises from about 70% to about 99%, preferably from about 75% to about 95%, and more preferably from about 80% to about 95% by weight of the total composition, of water. Alternatively, in another preferred embodiment, the composition is a hand dishwashing detergent composition, the composition comprises from about 30% to about 95%, preferably from about 40% to about 80%, and more preferably from about 50% to about 75% by weight of the total composition, of water.

In another preferred invention, the composition is an automatic dishwashing detergent composition. The composition comprises an alkoxylated polyalkyleneimine and a bleach system. The composition of the invention also comprises a bleach system comprising bleach and a bleach catalyst.

In the preferred embodiment wherein the composition is a hard surface cleaning composition, the composition has a pH from about 2 to about 14, preferably from about 2 to about 10, more preferably from about 2 to about 9.5, and even more preferably from about 2.1 to about 8, as is measured at 25° C. In the preferred embodiment wherein the composition is a hand dishwashing detergent composition, the composition has a pH from about 3 to about 14, preferably from about 6 to about 13, most preferably from about 8 to about 11.

1) Liquid Cleaning Compositions

The hard surface cleaning composition, the hand dishwashing detergent composition and the automatic dishwashing composition, all comprising the ethoxylated polyalkylenimine polymer according to the invention, and used to provide fast drying and/or to deliver shine on household hard surfaces may contain the following further ingredients:

Surfactant

Surfactants may be present in amounts from 0 to 15% by weight, preferably from 0.1% to 10%, and most preferably from 0.25% to 8% by weight of the total composition.

Surfactants may be desired herein as they contribute to the cleaning performance of the liquid cleaning compositions of the present invention. Suitable surfactants are selected from the group consisting of a nonionic surfactant or a mixture thereof; an anionic surfactant or a mixture thereof; an amphoteric surfactant or a mixture thereof; a zwitterionic surfactant or a mixture thereof; a cationic surfactant or a mixture thereof; and mixtures thereof.

In the preferred embodiment wherein the composition is a hard surface cleaning composition, the composition comprises from 1% to 60%, preferably from 5% to 30%, and more preferably from 10% to 25% by weight of the total composition of a surfactant.

In the preferred embodiment wherein the composition is a hand dishwashing detergent composition, the composition may comprise from 5% to 80%, preferably from 10% to 60%, more preferably from 12% to 45% by weight of the total composition of a surfactant. In preferred embodiments, the surfactant herein has an average branching of the alkyl chain (s) of more than 10%, preferably more than 20%, more preferably more than 30%, and even more preferably more than 40% by weight of the total surfactant.

Nonionic Surfactant

In one preferred embodiment, the liquid cleaning composition comprises a nonionic surfactant. Suitable nonionic surfactants may be alkoxylated alcohol nonionic surfactants, which can be readily made by condensation processes which are well-known in the art.

Accordingly, preferred alkoxylated alcohols for use herein are nonionic surfactants according to the formula $R^1O(E)_e(P)_pH$ where $R^1$ is a hydrocarbon chain of from about 2 to about 24 carbon atoms, E is ethylene oxide, P is propylene oxide, and e and p which represent the average degree of, respectively ethoxylation and propoxylation, are of from about 0 to about 24 (with the sum of e+p being at least 1). Preferably, the hydrophobic moiety of the nonionic compound can be a primary or secondary, straight or branched alcohol having from about 8 to about 24 carbon atoms.

Preferably, the nonionic surfactant is comprised in a typical amount of from about 2% to about 40%, preferably from about 3% to about 30% by weight of the liquid cleaning composition, and preferably from about 3 to about 20% by weight of the total composition.

Also suitable are alkylpolyglycosides having the formula $R^3O(C_nH_{2n}O)_t(\text{glycosyl})_z$ (formula (III)), wherein $R^3$ of formula (III) is selected from the group consisting of an alkyl or a mixture thereof; an alkyl-phenyl or a mixture thereof; a hydroxyalkyl or a mixture thereof; a hydroxyalkylphenyl or a mixture thereof; and mixtures thereof, in which the alkyl group contains from about 10 to about 18, preferably from about 12 to about 14 carbon atoms; n of formula (III) is about 2 or about 3, preferably about 2; t of formula (III) is from about 0 to about 10, preferably about 0; and z of formula (III) is from about 1.3 to about 10, preferably from about 1.3 to about 3, most preferably from about 1.3 to about 2.7. The glycosyl is preferably derived from glucose. Also suitable are alkyl glycerol ether and sorbitan ester.

Also suitable is fatty acid amide surfactant having the formula (IV):

$$R^6\overset{\overset{\displaystyle O}{\|}}{C}N(R^7)_2 \qquad \text{(IV)}$$

wherein $R^6$ of formula (IV) is an alkyl group containing from about 7 to about 21, preferably from about 9 to about 17, carbon atoms, and each $R^7$ of formula (IV) is selected from the group consisting of hydrogen; a $C_1$-$C_4$ alkyl or a mixture thereof; a $C_1$-$C_4$ hydroxyalkyl or a mixture thereof; and a $—(C_2H_4O)_yH$ or a mixture thereof, where y of formula (IV) varies from about 1 to about 3. Preferred amide can be a $C_8$-$C_{20}$ ammonia amide, a monoethanolamide, a diethanolamide, and an isopropanolamide.

In one preferred embodiment, the weight ratio of total surfactant to nonionic surfactant is from about 2 to about 10, preferably from about 2 to about 7.5, more preferably from about 2 to about 6.

Anionic Surfactant

Suitable anionic surfactants for use in the liquid cleaning composition can be a sulfate, a sulfosuccinate, a sulfoacetate, and/or a sulphonate; preferably an alkyl sulfate and/or an alkyl ethoxy sulfate; more preferably a combination of an alkyl sulfate and/or an alkyl ethoxy sulfate with a combined ethoxylation degree less than about 5, preferably less than about 3, more preferably less than about 2.

Sulphate or sulphonate surfactant is typically present at a level of at least about 5%, preferably from about 5% to about 40%, and more preferably from about 15% to about 30%, and even more preferably at about 15% to about 25% by weight of the liquid cleaning composition.

Suitable sulphate or sulphonate surfactants for use in the liquid cleaning composition include water-soluble salts or acids of $C_8$-$C_{14}$ alkyl or hydroxyalkyl, sulphate or sulphonates. Suitable counterions include hydrogen, alkali metal cation or ammonium or substituted ammonium, but preferably sodium. Where the hydrocarbyl chain is branched, it preferably comprises a $C_{1-4}$ alkyl branching unit. The average percentage branching of the sulphate or sulphonate surfactant is preferably greater than about 30%, more preferably from about 35% to about 80%, and most preferably from about 40% to about 60% of the total hydrocarbyl chain.

The sulphate or sulphonate surfactants may be selected from a $C_{11}$-$C_{18}$ alkyl benzene sulphonate (LAS), a $C_8$-$C_{20}$ primary, a branched-chain and random alkyl sulphate (AS); a $C_{10}$-$C_{18}$ secondary (2,3) alkyl sulphate; a $C_{10}$-$C_{18}$ alkyl alkoxy sulphate ($AE_xS$) wherein preferably x is from 1-30; a $C_{10}$-$C_{18}$ alkyl alkoxy carboxylate preferably comprising about 1-5 ethoxy units; a mid-chain branched alkyl sulphate as discussed in U.S. Pat. No. 6,020,303 and U.S. Pat. No. 6,060,443; a mid-chain branched alkyl alkoxy sulphate as discussed in U.S. Pat. No. 6,008,181 and U.S. Pat. No. 6,020,303; a modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; a methyl ester sulphonate (MES); and an alpha-olefin sulphonate (AOS).

The paraffin sulphonate may be monosulphonate or disulphonate and usually are mixtures thereof, obtained by sulphonating a paraffin of about 10 to about 20 carbon atoms. Preferred sulphonates are those of $C_{12-18}$ carbon atoms chains and more preferably they are $C_{14-17}$ chains.

Also suitable are the alkyl glyceryl sulphonate surfactant and/or alkyl glyceryl sulphate surfactant. A mixture of oligomeric alkyl glyceryl sulphonate and/or sulfate surfactant selected from a dimmer or a mixture thereof; a trimer or a mixture thereof; a tetramer or a mixture thereof; a pentamer or a mixture thereof; a hexamer or a mixture thereof; a heptamer or a mixture thereof; and mixtures thereof; wherein the alkyl glyceryl sulphonate and/or sulfate surfactant mixture comprises from about 0% to about 60% by weight of the monomers.

Other suitable anionic surfactants are alkyl, preferably dialkyl sulfosuccinate and/or sulfoacetate. The dialkyl sulfosuccinate may be a $C_{6-15}$ linear or branched dialkyl sulfosuccinate. The alkyl moiety may be symmetrical (i.e., the same alkyl moieties) or asymmetrical (i.e., different alkyl moiety.es). Preferably, the alkyl moiety is symmetrical.

Most common branched anionic alkyl ether sulphates are obtained via sulfation of a mixture of the branched alcohols and the branched alcohol ethoxylates. Also suitable are the sulfated fatty alcohols originating from the Fischer & Tropsh reaction comprising up to about 50% branching (about 40% methyl (mono or bi) about 10% cyclohexyl) such as those produced from the safol alcohols from Sasol; sulfated fatty alcohols originating from the oxo reaction wherein at least about 50% by weight of the alcohol is $C_2$ isomer (methyl to pentyl) such as those produced from the Isalchem® alcohols or Lial® alcohols from Sasol; the sulfated fatty alcohols originating from the modified oxo reaction wherein at least about 15% by weight of the alcohol is $C_2$ isomer (methyl to pentyl) such as those produced from the Neodol® alcohols from Shell.

Zwitterionic Surfactant and Amphoteric Surfactant

The zwitterionic and amphoteric surfactants for use in the liquid cleaning composition can be comprised at a level of from about 0.01% to about 20%, preferably from about 0.2% to about 15%, more preferably from about 0.5% to about 10% by weight of the hand dishwashing detergent composition.

Suitable zwitterionic surfactant in the preferred embodiment wherein contains both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylate and sulphonate, although other groups like sulfate, phosphonate, and the like can be used.

The liquid cleaning compositions may preferably further comprise an amine oxide and/or a betaine. Most preferred amine oxides are coconut dimethyl amine oxide or coconut amido propyl dimethyl amine oxide. Amine oxide may have a linear or mid-branched alkyl moiety. Typical linear amine oxides include water-soluble amine oxide containing one $R^4$ $C_{8-18}$ alkyl moiety and 2 $R^5$ and $R^8$ moieties selected from the group consisting of a $C_{1-3}$ alkyl group and a mixtures thereof; and a $C_{1-3}$ hydroxyalkyl group and a mixture thereof. Preferably amine oxide is characterized by the formula $R^4$—N($R^5$)($R^8$)→O wherein $R^4$ is a $C_{8-18}$ alkyl and $R^5$ and $R^8$ are selected from the group consisting of a methyl; an ethyl; a propyl; an isopropyl; a 2-hydroxethyl; a 2-hydroxypropyl; and a 3-hydroxypropyl. The linear amine oxide surfactant, in particular, may include a linear $C_{10}$-$C_{18}$ alkyl dimethyl amine oxide and a linear $C_8$-$C_{12}$ alkoxy ethyl dihydroxy ethyl amine oxide. Preferred amine oxides include linear $C_{10}$, linear $C_{10}$-$C_{12}$, and linear $C_{12}$-$C_{14}$ alkyl dimethyl amine oxides.

As used herein "mid-branched" means that the amine oxide has one alkyl moiety having $n_1$ carbon atoms with one alkyl branch on the alkyl moiety having $n_2$ carbon atoms. The alkyl branch is located on the α carbon from the nitrogen on the alkyl moiety. This type of branching for the amine oxide is also known in the art as an internal amine oxide. The total sum of $n_1$ and $n_2$ is from about 10 to about 24 carbon atoms, preferably from about 12 to about 20, and more preferably from about 10 to about 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein, "symmetric" means that $|n_1-n_2|$ is less than or equal to about 5, preferably about 4, most preferably from about 0 to about 4 carbon atoms in at least about 50 wt %, more preferably at least about 75 wt % to about 100 wt % of the mid-branched amine oxide for use herein.

The amine oxide further comprises two moieties, independently selected from a $C_{1-3}$ alkyl; a $C_{1-3}$ hydroxyalkyl group; or a polyethylene oxide group containing an average of from about 1 to about 3 ethylene oxide groups. Preferably the two moieties are selected from a $C_{1-3}$ alkyl, more preferably both are selected as a $C_1$ alkyl.

Other suitable surfactants include a betaine such an alkyl betaine, an alkylamidobetaine, an amidazoliniumbetaine, a sulfobetaine (INCI Sultaines), as well as a phosphobetaine, and preferably meets formula I:

$$R^{1'}—[CO—X(CH_2)_j]_g—N^+(R^{2'})(R^{3'})—(CH_2)_f—[CH(OH)—CH_2]_hY— \quad \text{(I) wherein}$$

$R^{1'}$ is a saturated or unsaturated $C_{6-22}$ alkyl residue, preferably a $C_{8-18}$ alkyl residue, in particular a saturated $C_{10-16}$ alkyl residue, for example a saturated $C_{12-14}$ alkyl residue;

X is NH, $NR^{4'}$ with $C_{1-4}$ alkyl residue $R^{4'}$, O or S, j is a number from about 1 to about 10, preferably from about 2 to about 5, in particular about 3, g is about 0 or about 1, preferably about 1, $R^{2'}$, $R^{3'}$ are independently a $C_{1-4}$ alkyl residue, potentially hydroxy substituted by such as a hydroxyethyl, preferably by a methyl.

f is a number from about 1 to about 4, in particular about 1, 2 or 3, h is about 0 or 1, and Y is selected from COO, $SO_3$, $OPO(OR^{5'})O$ or $P(O)(OR^{5'})O$, whereby $R^{5'}$ is a hydrogen atom H or a $C_{1-4}$ alkyl residue.

Preferred betaines are the alkyl betaine of the formula ($I_a$), the alkyl amido betaine of the formula ($I_b$), the sulfo betaine of the formula ($I_c$), and the Amido sulfobetaine of the formula ($I_d$);

$$R^{1'}—N^+(CH_3)_2—CH_2COO^- \quad (I_a)$$

$$R^{1'}—CO—NH(CH_2)_3—N^+(CH_3)_2—CH_2COO^- \quad (I_b)$$

$$R^{1'}—N^+(CH_3)_2—CH_2CH(OH)CH_2SO_3— \quad (I_c)$$

$$R^{1'}—CO—NH—(CH_2)_3—N^+(CH_3)_2—CH_2CH(OH)CH_2SO_3^- \quad (I_d)$$

in which $R^{1'}$ has the same meaning as in formula I. Particularly preferred betaines are the carbobetaine, wherein $Y^-$ is [$COO^-$], in particular the carbobetaine of formula ($I_a$) and ($I_b$), more preferred are the alkylamidobetaine of the formula ($I_b$).

Examples of suitable betaines and sulfobetaines are the following (designated in accordance with INCI): almondamidopropyl of betaine, apricotamidopropyl betaine, avocadamidopropyl of betaine, babassuamidopropyl of betaine, behenamidopropyl betaine, behenyl of betaine, betaine, canolamidopropyl betaine, capryl/capramidopropyl betaine, carnitine, cetyl of betaine, cocamidoethyl of betaine, cocamidopropyl betaine, cocamidopropyl hydroxysultaine, coco betaine, coco hydroxysultaine, coco/oleamidopropyl betaine, coco sultaine, decyl of betaine, dihydroxyethyl (O)eyl glycinate, dihydroxyethyl soy glycinate, dihydroxyethyl stearyl glycinate, dihydroxyethyl tallow glycinate, dimethicone propyl of PG-betaine, drucamidopropyl hydroxysultaine, hydrogenated tallow of betaine, isostearamidopropyl betaine, lauramidopropyl betaine, lauryl of betaine, lauryl hydroxysultaine, lauryl sultaine, milk amidopropyl betaine, milkamidopropyl of betaine, myristamidopropyl betaine, myristyl of betaine, oleamidopropyl betaine, oleamidopropyl hydroxysultaine, oleyl of betaine, olivamidopropyl of betaine, palmamidopropyl betaine, palmitamidopropyl betaine, palmitoyl carnitine, palm kernel amidopropyl betaine, polytetrafluoroethylene acetoxypropyl of betaine, ricinoleamidopropyl betaine, sesamidopropyl betaine, soyamidopropyl betaine, stearamidopropyl betaine, stearyl of betaine, tallowamidopropyl betaine, tallowamidopropyl hydroxysultaine, tallow of betaine, tallow dihydroxyethyl of betaine, undecylenamidopropyl betaine and wheat germ amidopropyl betaine. Preferred betaine is for example cocoamidopropyl betaine.

One particularly preferred zwitterionic surfactants for use in the preferred embodiment wherein the composition is a hard surface cleaning composition is the sulfobetaine surfactant, because it delivers optimum soap scum cleaning benefits.

Examples of particularly suitable sulfobetaine surfactants include tallow bis(hydroxyethyl) sulphobetaine and cocoamido propyl hydroxy sulphobetaine.

Cationic Surfactant

In one preferred embodiment, the liquid cleaning composition can comprise a cationic surfactant present in an effective amount, more preferably from about 0.1% to about 20%, by weight of the liquid cleaning composition. Suitable cationic surfactant is quaternary ammonium surfactant. Suitable quaternary ammonium surfactant is selected from the group consisting of a mono $C_6$-$C_{16}$, preferably a $C_6$-$C_{10}$ N-alkyl or an alkenyl ammonium surfactant or a mixture thereof, wherein the remaining N positions are substituted by a methyl, a hydroxyethyl or a hydroxypropyl group. Another preferred cationic surfactant is a $C_6$-$C_{18}$ alkyl or alkenyl ester of a quaternary ammonium alcohol, such as quaternary chlorine ester. More preferably, the cationic surfactant has formula (V):

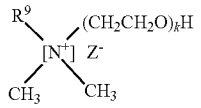

(V)

wherein $R^9$ of formula (V) is a $C_8$-$C_{18}$ hydrocarbyl or a mixture thereof, preferably, a $C_{8-14}$ alkyl, more preferably, a $C_8$, $C_{10}$ or $C_{12}$ alkyl; and Z of formula (V) is an anion, preferably, a chloride or a bromide.

Optional Ingredients

The liquid cleaning composition according to the present invention may comprise a variety of optional ingredients depending on the technical benefit aimed for and the surfaces treated.

Suitable optional ingredients for use herein include an alkaline material or a mixture thereof; an inorganic or organic acid and salt thereof or a mixture thereof; a buffering agent or a mixture thereof; a surface modifying polymer or a mixture thereof; a cleaning polymer or a mixture thereof; a peroxygen bleach or a mixture thereof; a radical scavenger or a mixture thereof; a chelating agent or a mixture thereof; a perfume or a mixture thereof; a dye or a mixture thereof; a hydrotrope or a mixture thereof; a polymeric suds stabilizer or a mixture thereof; a diamine or a mixture thereof; and mixtures thereof.

Solvent

Solvents are generally used to ensure preferred product quality for dissolution, thickness and aesthetics and to ensure better processing. The liquid cleaning composition of the present invention may further comprise a solvent or a mixture thereof, as an optional ingredient. Typically, in the preferred embodiment wherein the composition is a hard surface cleaning composition, the composition may comprise from about 0.1% to about 10%, preferably from about 0.5% to about 5%, and more preferably from about 1% to about 3% by weight of the total composition of a solvent or a mixture thereof. In the preferred embodiment wherein the composition is a hand dishwashing detergent composition, the composition contains from about 0.01% to about 20%, preferably from about 0.5% to about 20%, more preferably from about 1% to about 10% by weight of a solvent.

Suitable solvents herein include $C_1$-$C_5$ alcohols according to the formula $R^{10}$—OH wherein $R^{10}$ is a saturated alkyl group of from about 1 to about 5 carbon atoms, preferably from about 2 to about 4. Suitable alcohols are ethanol, propanol, isopropanol or mixtures thereof. Other suitable alcohols are alkoxylated $C_{1-8}$ alcohols according to the formula $R^{11}$-$(A_q)$-OH wherein $R^{11}$ is a alkyl group of from about 1 to about 8 carbon atoms, preferably from about 3 to about 6, and wherein A is an alkoxy group, preferably propoxy and/or ethoxy, and q is an integer of from 1 to 5, preferably from 1 to 2. Suitable alcohols are butoxy propoxy propanol (n-BPP), butoxy propanol (n-BP), butoxyethanol, or mixtures thereof. Suitable alkoxylated aromatic alcohols to be used herein are those according to the formula $R^{12}$—$(B)_r$—OH wherein $R^{12}$ is an alkyl substituted or non-alkyl substituted aryl group of from about 1 to about 20 carbon atoms, preferably from about 2 to about 15, and more preferably from about 2 to about 10, wherein B is an alkoxy group, preferably a butoxy, propoxy and/or ethoxy, and r is an integer of from 1 to 5, preferably from 1 to 2. A suitable aromatic alcohol to be used herein is benzyl alcohol. Suitable alkoxylated aromatic alcohol is benzylethanol and or benzylpropanol. Other suitable solvent includes butyl diglycolether, benzylalcohol, propoxypropoxypropanol (EP 0 859 044) ether and diether, glycol, alkoxylated glycol, $C_6$-$C_{16}$ glycol ether, alkoxylated aromatic alcohol, aromatic alcohol, aliphatic branched alcohol, alkoxylated aliphatic branched alcohol, alkoxylated linear $C_1$-$C_5$ alcohol, linear $C_1$-$C_5$ alcohol, amine, $C_8$-$C_{14}$ alkyl and cycloalkyl hydrocarbon and halohydrocarbon, and mixtures thereof.

Perfume

The liquid cleaning composition of the present invention may comprise a perfume ingredient, or mixtures thereof, in amount up to about 5.0% by weight of the total composition, preferably in amount of about 0.1% to about 1.5%. Suitable perfume compounds and compositions for use herein are for example those described in EP-A-0 957 156 under the paragraph entitled "Perfume", on page 13.

Dye

The liquid cleaning composition according to the present invention may be colored. Accordingly, it may comprise a dye or a mixture thereof. Suitable dyes for use herein are acid-stable dyes. By "acid-stable", it is meant herein a compound which is chemically and physically stable in the acidic environment of the composition herein.

pH Adjustment Agent

Alkaline Material

Preferably, an alkaline material may be present to trim the pH and/or maintain the pH of the composition according to the present invention. The amount of alkaline material is from about 0.001% to about 20%, preferably from about 0.01% to about 10%, and more preferably from about 0.05% to about 3% by weight of the composition.

Examples of the alkaline material are sodium hydroxide, potassium hydroxide and/or lithium hydroxide, and/or the alkali metal oxide, such as sodium and/or potassium oxide, or mixtures thereof. Preferably, the source of alkalinity is sodium hydroxide or potassium hydroxide, preferably sodium hydroxide.

Acid

The liquid cleaning composition of the present invention may comprise an acid. Any acid known to those skilled in the art may be used herein. Typically the composition herein may comprise up to about 20%, preferably from about 0.1% to about 10%, more preferably from about 0.1% to about 5%, even more preferably from about 0.1% to about 3%, by weight of the total composition of an acid.

Suitable acids are selected from the group consisting of a mono- and poly-carboxylic acid or a mixture thereof; a percarboxylic acid or a mixture thereof; a substituted carboxylic acid or a mixture thereof; and mixtures thereof. Carboxylic acids useful herein include $C_1$-$C_6$ linear or at least about 3 carbon containing cyclic acids. The linear or cyclic carbon-containing chain of the carboxylic acid may be substituted with a substituent group selected from the group consisting of hydroxyl, ester, ether, aliphatic groups having from about 1 to about 6, more preferably from about 1 to about 4 carbon atoms, and mixtures thereof.

Suitable mono- and poly-carboxylic acids are selected from the group consisting of citric acid, lactic acid, ascorbic acid, isoascorbic acid, tartaric acid, formic acid, maleic acid, malic acid, malonic acid, propionic acid, acetic acid, dehydroacetic acid, benzoic acid, hydroxy benzoic acid, and mixtures thereof.

Suitable percarboxylic acids are selected from the group consisting of peracetic acid, percarbonic acid, perboric acid, and mixtures thereof.

Suitable substituted carboxylic acids are selected from the group consisting of an amino acid or a mixture thereof; a halogenated carboxylic acid or a mixture thereof; and mixtures thereof.

Preferred acids for use herein are selected from the group consisting of lactic acid, citric acid, and ascorbic acid and mixtures thereof. More preferred acids for use herein are selected from the group consisting of lactic acid and citric acid and mixtures thereof. An even more preferred acid for use herein is lactic acid.

Salt

In a preferred embodiment, the liquid cleaning composition of the present invention also comprises other salts as the pH buffer. Salts are generally present at an active level of from about 0.01% to about 5%, preferably from about 0.015% to about 3%, more preferably from about 0.025% to about 2.0%, by weight of the composition.

When salts are included, the ions can be selected from magnesium, sodium, potassium, calcium, and/or magnesium, and preferably from sodium and magnesium, and are added as a hydroxide, chloride, acetate, sulphate, formate, oxide or nitrate salt to the composition of the present invention.

Diamine

In another preferred embodiment, the liquid cleaning composition of the present invention comprises a diamine or a mixture thereof as the pH buffer. The composition will preferably contain from about 0% to about 15%, preferably from about 0.1% to about 15%, preferably from about 0.2% to about 10%, more preferably from about 0.25% to about 6%, more preferably from about 0.5% to about 1.5% by weight of the total composition of at least one diamine.

Preferred organic diamines are those in which $pK_1$ and $pK_2$ are in the range of from about 8.0 to about 11.5, preferably in the range of from about 8.4 to about 11, even more preferably from about 8.6 to about 10.75. Preferred materials include 1,3-bis(methylamine) cyclohexane (pKa=from about 10 to about 10.5), 1,3-propane diamine ($pK_1$=10.5; $pK_2$=8.8), 1,6-hexane diamine ($pK_1$=11; $pK_2$=10), 1,3-pentane diamine (DYTEK EP®) ($pK_1$=10.5; $pK_2$=8.9), 2-methyl-1,5-pentane diamine (DYTEK AC)) ($pK_1$=11.2; $pK_2$=10.0). Other preferred materials include primary/primary diamines with alkylene spacers ranging from $C_4$ to $C_8$. In general, it is believed that primary diamines are preferred over secondary and tertiary diamines. pKa is used herein in the same manner as is commonly known to people skilled in the art of chemistry: in an all-aqueous solution at 25° C. and for an ionic strength between about 0.1 to about 0.5 M. values. Reference can be obtained from literature, such as from "Critical Stability Constants: Volume 2, Amines" by Smith and Martel, Plenum Press, NY and London, 1975.

Chelant

It has been found that the addition of a chelant in the liquid cleaning composition of the present invention provides an unexpected improvement in terms of its cleaning capability. In a preferred embodiment, the composition of the present invention may comprise a chelant at a level of from about 0.1% to about 20%, preferably from about 0.2% to about 5%, more preferably from about 0.2% to about 3% by weight of total composition.

Suitable chelants can be selected from the group consisting of an amino carboxylate or a mixture thereof; an amino phosphonate or a mixture thereof; a polyfunctionally-substituted aromatic chelant or a mixture thereof; and mixtures thereof.

Preferred chelants for use herein are the amino acid based chelants, and preferably glutamic-N,N-diacetic acid (GLDA) and derivatives, and/or phosphonate based chelants, and preferably diethylenetriamine pentamethylphosphonic acid. GLDA (salts and derivatives thereof) is especially preferred according to the invention, with the tetrasodium salt thereof being especially preferred.

Also preferred are amino carboxylates including ethylenediaminetetra-acetate, N-hydroxyethylethylenediaminetriacetate, nitrilo-triacetate, ethylenediamine tetrapro-prionate, triethylenetetraaminehexacetate, diethylenetriaminepentaacetate, ethanoldi-glycine; and alkali metal, ammonium, and substituted ammonium salts thereof; and mixtures thereof; as well as MGDA (methylglycine-diacetic acid), and salts and derivatives thereof;

Other chelants include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least about two carboxyl groups which are in each case separated from one another by, preferably, no more than about two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulphonates.

Further suitable polycarboxylates chelants for use herein include acetic acid, succinic acid, formic acid; all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

Amino phosphonates are also suitable for use as chelant and include ethylenediaminetetrakis (methylenephosphonates) as DEQUEST. Preferably, these amino phosphonates do not contain alkyl or alkenyl groups with more than about 6 carbon atoms.

Polyfunctionally-substituted aromatic chelants are also useful in the composition herein, such as described in U.S. Pat. No. 3,812,044. Preferred compounds of this type in acid form are dihydroxydisulfobenzenes such as 1,2-dihydroxy-3,5-disulfobenzene.

Hydrotrope

The liquid cleaning composition of the present invention may optionally comprise a hydrotrope in an effective amount so that the composition is appropriately compatible in water. The composition of the present invention typically comprises from about 0% to about 15% by weight of the total composition of a hydrotropic, or mixtures thereof, preferably from about 1% to about 10%, most preferably from about 3% to about 6%. Suitable hydrotropes for use herein include anionic-type hydrotropes, particularly sodium, potassium, and ammonium xylene sulphonate, sodium, potassium and ammonium toluene sulphonate, sodium potassium and ammonium cumene sulphonate, and mixtures thereof, and related compounds, as disclosed in U.S. Pat. No. 3,915,903.

Polymeric Suds Stabilizer

The liquid cleaning composition of the present invention may optionally contain a polymeric suds stabilizer. These polymeric suds stabilizers provide extended suds volume and suds duration of the composition. The composition preferably contains from about 0.01% to about 15%, preferably from about 0.05% to about 10%, more preferably from about 0.1% to about 5%, by weight of the total composition of the polymeric suds booster/stabilizer.

These polymeric suds stabilizers may be selected from homopolymers of a (N,N-dialkylamino) alkyl ester and a (N,N-dialkylamino) alkyl acrylate ester. The weight average molecular weight of the polymeric suds booster, determined via conventional gel permeation chromatography, is from about 1,000 to about 2,000,000, preferably from about 5,000 to about 1,000,000, more preferably from about 10,000 to about 750,000, more preferably from about 20,000 to about 500,000, even more preferably from about 35,000 to about 200,000. The polymeric suds stabilizer can optionally be present in the form of a salt, either an inorganic or organic salt, for example the citrate, sulphate, or nitrate salt of (N,N-dimethylamino)alkyl acrylate ester.

One preferred polymeric suds stabilizer is (N,N-dimethylamino)alkyl acrylate ester, namely the acrylate ester represented by the formula (VII):

(VII)

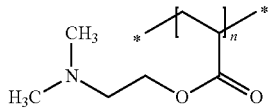

Other preferred suds boosting polymers are copolymers of hydroxypropylacrylate/dimethyl aminoethylmethacrylate (copolymer of HPA/DMAM), represented by the formulae VIII and IX (VIII)

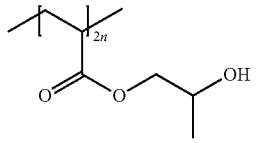

(IX)

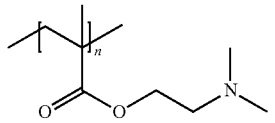

Another preferred class of polymeric suds booster polymers are hydrophobically modified cellulosic polymers having a weight average molecular weight ($M_w$) below about 45,000; preferably between about 10,000 and about 40,000; more preferably between about 13,000 and about 25,000. The hydrophobically modified cellulosic polymers include water soluble cellulose ether derivatives, such as nonionic and cationic cellulose derivatives. Preferred cellulose derivatives include methylcellulose, hydroxypropyl methylcellulose, hydroxyethyl methylcellulose, and mixtures thereof.

2) Automatic Dishwashing Detergent Composition

The automatic dishwashing detergent composition preferably comprises the polyalykyleneimine in a level of from about 0.0001% to about 10% by weight of the detergent composition, more preferably from about 0.0005% to about 5% and most preferably from about 0.001% to about 1% and especially from about 0.005% to about 0.5% by weight of the dishwasher detergent composition.

The automatic dishwashing composition comprising the polymer according to the invention provides outstanding bleaching benefits. Without being bound by theory, it is believed that the polyalkyleneimine forms a complex with the bleach catalyst, the complex has such a charge and steric configuration that it is driven to the stained surfaces, thus the bleach catalyst can work on removing the stains in situ instead of in the bulk of the cleaning solution, that is where usually takes place. This mechanism seems to be extremely efficient for stain removal, especially for the removal of tea and coffee stains. The relationship between the molecular weight of the polyalkyleneimine backbone and the total molecular weight of the alkoxylated polyalkyleneimine and preferably the degree of quaternization of the polyalkyleneimine are critical for the formation of a bleach catalyst/polyalkyleneimine complex that would selectively go to bleachable stains improving the efficacy of the bleach catalyst.

The degree of quaternization also helps with the stability of the polyalkyleneimine in the composition of the invention, in particular it protects the polyalkyleneimine from oxidizing agents such as bleach, contributing to the stability on storage of the composition.

In preferred embodiments the bleach is an oxygen bleach and the bleach system further comprises a bleach activator.

It has been found that the best bleachable stain removal performance occurs when the bleach catalyst is a cobalt or preferably manganese bleach catalyst, however bleach catalysts based on other common transition metals, e.g. copper, iron, molybdenum, tungsten, etc., may also be used.

The composition of the invention gives rise to outstanding bleachable stain removal benefits even when it is phosphate free. Especially good performance is obtained when the composition comprises a sulfonated polymer.

Bleach System

The bleach system of the composition of the invention comprises a bleach and optionally a bleach activator. The synergy between the bleach catalyst and the polyalkyleneimine of the invention allows for a reduction of the level of the bleach system in a detergent composition without losing and even increasing the bleachable stain removal benefit.

Bleach

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially diperoxydodecanedioc acid, diperoxytetradecanedioc acid, and diperoxyhexadecanedioc acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid, N-id[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Preferably, the level of bleach in the composition of the invention is from about 1 to about 20%, more preferably from about 2 to about 15%, even more preferably from about 3 to about 12% and especially from about 4 to about 10% by weight of the composition.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.01 to about 10%, preferably from about 0.1 to about 5% and more preferably from about 1 to about 4% by weight of the total composition.

Bleach Catalyst

The composition herein contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16.

Suitable catalysts for use herein include cobalt (III) catalysts having the formula:

$$Co[(NH3)nMmBbTtQqPp]Yy$$

wherein cobalt is in the +3 oxidation state; n is an integer from 0 to 5 (preferably 4 or 5; most preferably 5); M represents a monodentate ligand; m is an integer from 0 to 5 (preferably 1 or 2; most preferably 1); B represents a bidentate ligand; b is an integer from 0 to 2; T represents a tridentate ligand; t is 0 or 1; Q is a tetradentae ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, nitrate, nitrite, sulfate, citrate, acetate, carbonate, and combinations thereof; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred cobalt catalysts have the formula:

$$[Co(NH3)n(M)m]Yy$$

wherein n is an integer from 3 to 5 (preferably 4 or 5; most preferably 5); M is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The most preferred cobalt catalyst useful herein has the formula [Co(NH3)5Cl]Yy., and especially [Co(NH3)5Cl]Cl2.

Suitable M, B, T, Q and P ligands for use herein are known, such as those ligands described in U.S. Pat. No. 4,810,410, to Diakun et al, issued Mar. 7, 1989. In addition, examples of M include pryidine and SCN; examples of B include ethylenediamine, bipyridine, acetate, phenthroline, biimidazole, and tropolone; examples of T include terpyridine, acylhydrazones of salicylaldehyde, and diethylenetriamine; examples of Q include triethylenetetramine, N(CH2CH2NH2)3, Schiff bases (for example HOCH2CH2C═NCH2CH2N═CCH2CH2OH); and examples of P include polyimidazoles and HOCH2CH2C═NCH2CH2NH—CH2CH2N═CCH2CH2OH.

These cobalt catalysts are readily prepared by known procedures, such as taught for example in U.S. Pat. No. 4,810,410, to Diakun et al, issued Mar. 7, 1989, and J. Chem. Ed. (1989), 66 (12), 1043-45; The Synthesis and Characterization of Inorganic Compounds, W. L. Jolly (Prentice-Hall; 1970), pp. 461-3.

Manganese bleach catalysts are preferred for use in the composition of the invention. These catalysts in combination with the polyalkyleneimine provide the best results in terms of removal of bleachable stains. Especially preferred catalyst for use here is a dinuclear manganese-complex having the general formula:

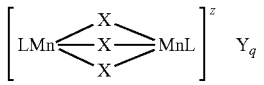

wherein Mn is manganese which can individually be in the III or IV oxidation state; each x represents a coordinating or bridging species selected from the group consisting of H2O, O22-, O2-, OH—, HO2-, SH—, S2-, >SO, Cl—, N3-, SCN—, RCOO—, NH2- and NR3, with R being H, alkyl or aryl, (optionally substituted); L is a ligand which is an organic molecule containing a number of nitrogen atoms which coordinates via all or some of its nitrogen atoms to the manganese centres; z denotes the charge of the complex and is an integer which can be positive or negative; Y is a monovalent or multivalent counter-ion, leading to charge neutrality, which is dependent upon the charge z of the complex; and q=z/[charge Y].

Preferred manganese-complexes are those wherein x is either $CH_3COO^-$ or $O^2$ or mixtures thereof, most preferably wherein the manganese is in the IV oxidation state and x is $O^{2-}$. Preferred ligands are those which coordinate via three nitrogen atoms to one of the manganese centres, preferably being of a macrocyclic nature. Particularly preferred ligands are:

(1) 1,4,7-trimethyl-1,4,7-triazacyclononane, (Me-TACN); and (2) 1,2,4,7-tetramethyl-1,4,7-triazacyclononane, (Me-Me TACN).

The type of counter-ion Y for charge neutrality is not critical for the activity of the complex and can be selected from, for example, any of the following counter-ions: chloride; sulphate; nitrate; methylsulphate; surfactant anions, such as the long-chain alkylsulphates, alkylsulphonates, alkylbenzenesulphonates, tosylate, trifluoromethylsulphonate, perchlorate ($ClO_4^-$), $BPh_4^-$, and $PF_6^-$ though some counter-ions are more preferred than others for reasons of product property and safety.

Consequently, the preferred manganese complexes useable in the present invention are:

(I) $[(Me\text{-}TACN)Mn^{IV}(\hat{A}\mu\text{-}0)_3Mn^{IV}(Me\text{-}TACN)]^{2+}(PF_6^-)_2$ (II) $[(Me\text{-}MeTACN)Mn^{IV}(\hat{A}\mu\text{-}0)_3Mn^{IV}(Me\text{-}MeTACN)]^{2+}(PF_6^-)_2$ (III) $[(Me\text{-}TACN)Mn^{III}(\hat{A}\mu\text{-}0)(\hat{A}\mu\text{-}OAc)_2Mn^{III}(Me\text{-}TACN)]^{2+}(PF_6^-)_2$ (IV) $[(Me\text{-}MeTACN)Mn^{III}(\hat{A}\mu\text{-}0)(\hat{A}\mu\text{-}OAc)_2Mn^{III}(Me\text{-}MeTACN)]^{2+}(PF_6^-)_2$ which hereinafter may also be abbreviated as:

(I) $[Mn^{IV}{}_2(\hat{A}\mu\text{-}0)_3(Me\text{-}TACN)2](PF_6)_2$ (II) $[Mn^{IV}{}_2(\hat{A}\mu\text{-}0)_3(Me\text{-}MeTACN)_2](PF_6)_2$ (III) $[Mn^{III}{}_2(\hat{A}\mu\text{-}0)(\hat{A}\mu\text{-}OAc)_2(Me\text{-}TACN)_2](PF_6)_2$ (IV) $[Mn^{III}{}_2(\hat{A}\mu\text{-}0)(\hat{A}\mu\text{-}OAc)_2(Me\text{-}TACN)_2](PF_6)_2$ The structure of I is given below:

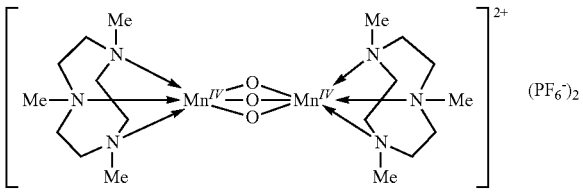

abbreviated as $[Mn^{IV}{}_2(\hat{A}\mu\text{-}0)_3(Me\text{-}TACN)_2](PF_6)_2$.

It is of note that the manganese complexes are also disclosed in EP-A-0458397 and EP-A-0458398 as unusually effective bleach and oxidation catalysts. In the further description of this invention they will also be simply referred to as the "catalyst".

Bleach catalyst are included in the compositions of the invention are in a preferred level of from about 0.001 to about 10%, preferably from about 0.05 to about 2% by weight of the total composition.

The detergent composition can comprises in addition to the alkoxylated polyalkyleneimine and the bleach system, one or more detergent active components which may be selected from surfactants, enzymes, drying aids, metal care agents, etc.

SYNTHESIS EXAMPLES

The amount of alkylating agent determines the amount of quaternization of the amino groups in the polymer, i.e. the amount of quaternized moieties.

The amount of the quaternized moieties can be calculated from the difference of the amine number in the non-quaternized amine and the quaternized amine.

The amine number can be determined according to the method described in DIN 16945.

Example 1

Synthesis of PEI5000+7EO/NH, 50% Quaternized with Dimethyl Sulfate a) PEI5000+1EO/NH In a 3.5 l autoclave 2568.0 g of a polyethyleneimine 5000 (average molecular weight $M_w$ of 5000, 50% solution in water) were heated to 80° C. and purged three times with nitrogen up to a pressure of 5 bar. After the temperature had been increased to 110° C., 1314.2 g ethylene oxide were added in portions up to 7 bar. To complete the reaction, the mixture was allowed to post-react for 2 h at 110° C. The reaction mixture was stripped with nitrogen and volatile compounds were removed in vacuum at 70° C. The temperature was increased to 90-110° C. and the mixture was dewatered for 2 hours in vacuum.

2580.0 g of polyethyleneimine 5000 with 1 mole of ethylene oxide per mole NH were obtained as a dark brown viscous oil (Amine value: 512 mg KOH/g).

b) PEI5000+7EO/NH

In a 5 l autoclave 997.6 g of the product obtained in Example 1a) and 29.9 g of a 50% by weight aqueous solution of potassium hydroxide were heated to 80° C. and purged three times with nitrogen. The mixture was dewatered at 120° C. and a vacuum of 10 mbar for 2 h. After the vacuum had been removed with nitrogen, the temperature was increased to 140° C. and 3027.2 g ethylene oxide were added in portions up to 7 bar. To complete the reaction, the mixture was allowed to post-react for 2 h at 120° C. The reaction mixture was stripped with nitrogen and volatile compounds were removed in vacuum at 70° C.

4040.0 g of a polyethyleneimine 5000 with 7 mole of ethylene oxide per mole NH bond were obtained as a brown viscous liquid (Amine value: 137.4 mg KOH/g; pH of a 10% by weight aqueous solution: 11.7; viscosity (70° C.): 325 mPas).

c) PEI5000+7EO/NH, 50% Quaternized with Dimethyl Sulfate

In a 2 l reaction vessel 1500.0 g of the product from example 1b) was heated to 70-75° C. under a constant stream of nitrogen. 232.0 g dimethyl sulfate was added within 2 h. The reaction mixture was stirred for additional 2 h at 75° C.

1720.0 g of light brown solid were obtained (Amine value: 63.3 mg KOH/g; pH of a 10% by weight aqueous solution: 7.8; Viscosity (70° C.): 838 mPas).

Example 2

Synthesis of PEI600+10EO/NH, 75% Quaternized with Dimethyl Sulfate a) PEI600+1EO/NH In a 3.5 l autoclave 1328.5 g of a polyethyleneimine 600 (average molecular weight $M_W$ of 600) and 66.4 g water were heated to 80° C. and purged three times with nitrogen up to a pressure of 5 bar. After the temperature had been increased to 120° C., 1359.4 g ethylene oxide were added in portions up to 7 bar. To complete the reaction, the mixture was allowed to post-react for 2 h at 120° C. The reaction mixture was stripped with nitrogen and volatile compounds were removed in vacuo at 70° C. The temperature was increased to 90-110° C. and the mixture was dewatered for 2 hours in vacuo.

2688.0 g of polyethyleneimine 600 with 1 mole of ethylene oxide per mole NH were obtained as a yellow viscous oil (Amine value: 549 mg KOH/g; pH of a 1% by weight aqueous solution: 11.06).

b) PEI600+10 EO/NH

In a 5 l autoclave 704.5 g of the product obtained in Example 1a) and 21.1 g of a 50% by weight aqueous solution of potassium hydroxide were heated to 80° C. and purged three times with nitrogen. The mixture was dewatered at 120° C. and a vacuum of 10 mbar for 2 h. After the vacuum had been removed with nitrogen, the temperature was increased to 145° C. and 3206.7 g ethylene oxide were added in portions up to 7 bar. To complete the reaction, the mixture was allowed to post-react for 2 h at 120° C. The reaction mixture was stripped with nitrogen and volatile compounds were removed in vacuo at 70° C.

3968.0 g of a polyethyleneimine 600 with 10 mole of ethylene oxide per mole NH bond were obtained as a yellow-brown viscous liquid (Amine value: 101.5 mg KOH/g; pH of a 10% by weight aqueous solution: 11.6).

c) PEI600+10 EO/NH, 75% Quaternized with Dimethyl Sulfate

In a 0.5 l reaction vessel 120.0 g of the product from example 1b) was heated to 70-75° C. under a constant stream of nitrogen. 20.5 g dimethyl sulfate was added within 15 min. The reaction mixture was stirred for additional 2 h at 75° C. For adjusting pH, 1.0 g NaOH (50% in water) was added.

110.0 g of light brown solid were obtained (Amine value: 23.5 mg KOH/g; pH of a 10% by weight aqueous solution: 9.3).

Example 3

Synthesis of PEI600+7EO/NH, 75% Quaternized with Dimethyl Sulfate a) PEI600+7 EO/NH In a 2 l autoclave 261.0 g of the product obtained in Example 1a) and 7.8 g of a 50% by weight aqueous solution of potassium hydroxide were heated to 80° C. and purged three times with nitrogen. The mixture was dewatered at 120° C. and a vacuum of 10 mbar for 2 h. After the vacuum had been removed with nitrogen, the temperature was increased to 145° C. and 792.0 g ethylene oxide were added in portions up to 7 bar. To complete the reaction, the mixture was allowed to post-react for 2 h at 120° C. The reaction mixture was stripped with nitrogen and volatile compounds were removed in vacuo at 70° C.

1056.0 g of a polyethyleneimine 600 with 7 mole of ethylene oxide per mole NH bond were obtained as a yellow-brown viscous liquid (Amine value: 147.8 mg KOH/g; pH of a 10% by weight aqueous solution: 11.6).

b) PEI600+7 EO/NH, 75% Quaternized with Dimethyl Sulfate

In a 0.5 l reaction vessel 250.0 g of the product from example 2a) was heated to 70-75° C. under a constant stream of nitrogen. 58.4 g dimethyl sulfate was added within 15 min. The reaction mixture was stirred for additional 2 h at 75° C.

299.0 g of light brown solid were obtained (Amine value: 35.84 mg KOH/g; pH of a 10% by weight aqueous solution: 6.0; Iodine color number (10% in water): 4.0).

Application Examples

1) Shine Test

Method of Use

In the method aspect of this invention, soiled dishes are contacted with an effective amount, typically from about 0.5 ml. to about 20 ml. (per 25 dishes being treated), preferably from about 3 ml. to about 10 ml., of the liquid detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. Suitable examples may be seen below in Table I.

Generally, from about 0.01 ml. to about 150 ml., preferably from about 3 ml. to about 40 ml. of a liquid detergent composition of the invention is combined with from about 2000 ml. to about 20000 ml., more typically from about 5000 ml. to about 15000 ml. of water in a sink having a volumetric capacity in the range of from about 1000 ml. to about 20000 ml., more typically from about 5000 ml. to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of use will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

Test Methods

Molecular Weight Determination:

Molecular weight is determined as weight-average molecular weight ($M_w$) by gel permeation chromatography (GPC) using a serial configuration of the GPC columns HEMA Bio linear, 40·8 mm 10 μm, HEMA Bio 100, 300·8 mm, 10 μm, HEMA Bio 1000, 300·8 mm, 10 μm and HEMA Bio 10000, 300·8 mm, 10 μm, (obtained from PSS Polymer Standards Service GmbH, Mainz, Germany). The eluent is 1.5% aqueous formic acid, flow is 1 ml/min, injected volume is 20 μl, sample concentration is 1%. The method is calibrated with a Pullulan standard (MW 342-1660000 g/mol, obtained from PSS Polymer Standards Service GmbH, Mainz, Germany).

Shine Test Method

The formulation to be tested is diluted with tap water (water hardness: 15 gpg, temperature: 40° C.) in order to obtain a 10% solution of the original formulation. This solution is applied by a sponge to 3 drinking glasses, which are then rinsed for 10 seconds under running water (water hardness: 15 gpg (grains-per-gallon); temperature: 40° C.). The glasses are stored vertically after rinsing and allowed to dry at ambient temperature (20° C.). After drying, the glasses are graded visually by two judges for shine on a 0 to 6 point scale (0=complete absence of streaks; 6=extremely bad streaks). A good shine result is one corresponding to a grading lower than 2.

Viscosity Test Method

The viscosity of the composition of the present invention is measured on a Brookfield viscometer model # LVDVII+ at 20° C. The spindle used for these measurements is S31 with the appropriate speed to measure products of different viscosities; e.g., 12 rpm to measure products of viscosity greater than 1000 cps; 30 rpm to measure products with viscosities between 500 cps-1000 cps; 60 rpm to measure products with viscosities less than 500 cps.

Examples

Hand Dish Examples

Table 1 shows a known liquid cleaning composition which was prepared. The composition was prepared to show the shine benefit obtained in Hand Dishwashing by the addition of specific polyethyleneimine structures, as shown in Table 2.

TABLE 1

Cleaning Compositions before adding Alkoxylated Polyethyleneimine

| Examples | (% w/w) |
|---|---|
| Alkyl ethoxy sulfate $AE_xS$* | 16 |
| Amine oxide | 5.0 |
| $C_{9-11}$ $EO_8$ | 5 |
| Ethylan 1008 ® | — |
| Lutensol ® TO 7 | — |
| GLDA[1] | 0.7 |
| DTPMP[2] | — |
| Sodium citrate | — |
| Solvent | 1.3 |
| Polypropylene glycol ($M_n$ = 2000) | 0.5 |
| Sodium chloride | 0.8 |
| Water | to balance |

*Number of carbon atoms in the alkyl chain is between 12 and 13; and x is between 0.5 and 2. Ethylan 1008 ® is a nonionic surfactant based on a synthetic primary alcohol, commercially available from AkzoNobel.

Lutensol ® TO 7 is nonionic surfactant made from a saturated iso-$C_{13}$ alcohol.

Solvent is ethanol

Amine oxide is coconut dimethyl amine oxide.

[1]Glutamic-N,N-diacetic acid

[2]Diethylenetriamine penta methylphosphonic acid

**Examples may have other optional ingredients such as dyes, opacifiers, perfumes, preservatives, hydrotropes, processing aids, salts, stabilizers, etc.

Table 2 shows a series of compositions prepared and tested for shine. The base formulation for all compositions was Formulation I from Table 1 above. Except for the control sample (2A), each of the compositions comprised 0.1% of an ethoxylated polyethyleneimine having the characteristics specified in the table. Shine testing was performed according to the method disclosed above. All compositions deliver good cleaning. Compositions 2A through 2G do not deliver good shine. Compositions 2H, 2I and 2J are very good on shine.

TABLE 2

Shine Benefit from Addition of Selected Modified Polyethyleneimines into Cleaning Composition

| | 2A (Control) | 2B | 2C | 2D | 2E | 2F | 2G | 2H | 2I | 2J |
|---|---|---|---|---|---|---|---|---|---|---|
| % Formulation I | 100% | 99.9% | 99.9% | 99.9% | 99.9% | 99.9% | 99.9% | 99.9% | 99.9% | 99.9% |
| % PEI | 0% | 0.1% | 0.1% | 0.1% | 0.1% | 0.1% | 0.1% | 0.1% | 0.1% | 0.1% |
| PEI Properties | | | | | | | | | | |
| PEI Backbone MW | — | 600 | 600 | 600 | 600 | 600 | 600 | 600 | 600 | 5000 |
| EO Substitution* | — | 7 | 20 | 10 | 10 | 10 | 10 | 7 | 20 | 7 |
| PO Substitution** | — | 0 | 0 | 16 | 16 | 16 | 16 | 0 | 0 | 0 |
| % Quaternization | — | 12% | 8% | 24% | 48% | 73% | 90% | 76% | 100% | 50% |
| Results | | | | | | | | | | |
| Shine Grade | 2.7 | 3.0 | 2.5 | 3.0 | 2.25 | 2.5 | 2.2 | 1.0 | 1.0 | 1.0 |

*moles of ethylene oxide per mole of NH

**moles of propylene oxide per mole of NH

2) Bleach-Booster Test

Abbreviations Used in the Example

In the example, the abbreviated component identifications have the following meanings:

| | |
|---|---|
| Percarbonate | Sodium percarbonate of the nominal formula $2Na_2CO_3 \cdot 3H_2O_2$ |
| TAED | Tetraacetylethylenediamine |
| Cobalt catalyst | Pentaamine acetatocobalt (III) nitrate |
| MnTACN | 1,4,7-trimethyl 1,4,7 triazacyclononane |
| Sodium carbonate | Anhydrous sodium carbonate |
| Acusol 588 | Sulfonated polymer supplied by Rohm & Haas |
| NI surfactant | Non-ionic surfactant |
| BTA | Benzotriazole |
| HEDP | 1-hydroxyethyidene-1,1-diphosphonic acid |
| MGDA | methylglycinediacetic acid |
| DPG | Dipropylene glycol |

In the following examples the levels are quoted in grams.

Examples

The compositions tabulated below (given in grams) are introduced into a dual-compartment water-soluble pack having a first compartment comprising a solid composition (in powder form) and a liquid compartment comprising the liquid composition. The water-soluble film used is Monosol M8630 film as supplied by Monosol.

| | Powder | | | |
|---|---|---|---|---|
| | A | B | C | D |
| Percarbonate | 1.41 | 1.41 | 1.41 | 1.41 |
| TAED | 0.32 | 0.32 | 0.32 | 0.32 |
| Cobalt catalyst | 0.0013 | 0.0013 | — | — |
| Mn TACN | — | — | 0.0013 | 0.0013 |
| Sodium carbonate | 7.17 | 7.17 | 7.17 | 7.17 |
| Sodium Sulphate | 2.5 | 2.5 | 2.5 | 2.5 |
| Amylase | 0.0013 | 0.0013 | 0.0013 | 0.0013 |
| Protease | 0.013 | 0.013 | 0.013 | 0.013 |
| Acusol 588 | 1.20 | 1.20 | 1.20 | 1.20 |
| NI surfactant | 0.10 | 0.10 | 0.10 | 0.10 |
| BTA | 0.0080 | 0.0080 | 0.0080 | 0.0080 |
| HEDP | 0.10 | 0.10 | 0.10 | 0.10 |
| MGDA | 2.20 | 2.20 | 2.20 | 2.20 |
| Liquid Top | | | | |
| NI surfactant | 1.17 | 1.17 | 1.17 | 1.17 |
| DPG | 0.44 | 0.44 | 0.44 | 0.44 |
| Amine Oxide | 0.05 | 0.05 | 0.05 | 0.05 |
| Glycerine | 0.08 | 0.08 | 0.08 | 0.08 |
| PEI600 EO7 PO1 90% Quat | — | 0.25 | — | 0.25 |

The exemplified compositions were used to wash tea stained cups in an automatic dishwasher Miele G1022SC, using the 50° C. program (Cold Fill). Hard water was used (20-21 gpg). The cups were washed in the presence of 50 g of the soil specified below. The soil is added to the dishwasher floor in the main wash. The detergent is delivered into the main wash after the dispenser drawer opens.

The cups were grading using a 1-10 grading scale where 1=highly stained cup; 10=completely clean cup. As it can be seen from the table below, the stain removal achieved by composition comprising the polyethyleneimine of the invention is far better than that achieved with compositions free of polyethylenimine.

The soil is prepared according to the following recipe:

| Ingredients | |
|---|---|
| Vegetable Oil | 1580 g +/− 1 g |
| Vegetable Oil (in separate container) | 315 g +/− 1 g |
| Margarine | 315 g +/− 1 g |
| Lard | 315 g +/− 1 g |
| Eggs | 790 g +/− 1 g |
| Cream | 470 g +/− 1 g |
| Milk | 315 g +/− 1 g |
| Potato Flakes | 110 g +/− 1 g |
| Gravy Granules | 85 g +/− 1 g |
| Corn Flour | 30 g +/− 1 g |
| Cheese Powder | 30 g +/− 1 g |
| Benzoic Acid | 15 g +/− 1 g |
| Tomato Ketchup | 315 g +/− 1 g |
| English Mustard | 315 g +/− 1 g |
| Total | 5000 g |

Soil Preparation

1. Mix the egg and larger portion of vegetable oil together and blend with hand blender.
2. Add the mustard and ketchup stirring them well in.
3. Melt the lard, small portion of oil and margarine together then allow to cool to approx 40° C. then add to the mixture and blend well.
4. Stir in cream and milk.
5. Crush up the smash into powder with a pestle and mortar. Add the powdered solid ingredients and mix everything to a smooth paste.

| | Composition | | | |
|---|---|---|---|---|
| | A | B | C | D |
| Grading score | 3.8 | 7.3 | 7.3 | 10 |

Additional examples according to the present invention are provided herebelow.

| | Powder | | | |
|---|---|---|---|---|
| | E | F | G | H |
| Percarbonate | 1.41 | 1.41 | 1.41 | 1.41 |
| TAED | 0.32 | 0.32 | 0.32 | 0.32 |
| Cobalt catalyst | 0.0013 | 0.0013 | — | — |
| Mn TACN | — | — | 0.0013 | 0.0013 |
| Sodium carbonate | 7.17 | 7.17 | 7.17 | 7.17 |
| Sodium Sulphate | 2.5 | 2.5 | 2.5 | 2.5 |
| Amylase | 0.0013 | 0.0013 | 0.0013 | 0.0013 |
| Protease | 0.013 | 0.013 | 0.013 | 0.013 |
| Acusol 588 | 1.20 | 1.20 | 1.20 | 1.20 |
| NI surfactant | 0.10 | 0.10 | 0.10 | 0.10 |
| BTA | 0.0080 | 0.0080 | 0.0080 | 0.0080 |
| HEDP | 0.10 | 0.10 | 0.10 | 0.10 |
| MGDA | 2.20 | 2.20 | 2.20 | 2.20 |
| PEI600 EO7 PO1 90% Quat | | | 0.25 | |
| PEI600 EO7 (nil PO) 75% Quat | 0.25 | | | |
| Liquid Top | | | | |
| NI surfactant | 1.17 | 1.17 | 1.17 | 1.17 |
| DPG | 0.44 | 0.44 | 0.44 | 0.44 |
| Amine Oxide | 0.05 | 0.05 | 0.05 | 0.05 |
| Glycerine | 0.08 | 0.08 | 0.08 | 0.08 |
| PEI600 EO7 (nil PO) 75% Quat | | 0.25 | | 0.25 |

Compositions E-H also provide outstanding stain removal.

What is claimed is:

1. An ethoxylated polyethyleneimine having the general structure of formula (I):

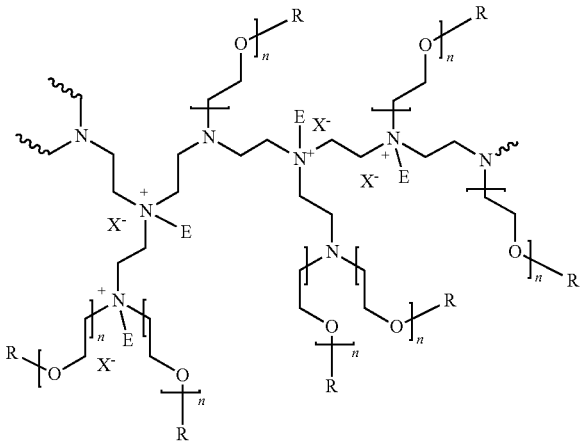

wherein n has a value which lies in the range of from 1 to 40, R is selected from hydrogen, a $C_1$-$C_4$ alkyl and mixtures thereof, E represents a $C_1$-$C_{12}$ alkyl unit, $X^-$ represents a suitable water soluble counterion and the degree of quaternization of the nitrogen atoms present in the polyethyleneimine backbone lies in the range of from 50% to 100%.

2. The ethoxylated polyethyleneimine according to claim 1, wherein the degree of quaternization of the nitrogen atoms present in the polyethyleneimine backbone lies in the range of from 60% to about 95%.

3. The ethoxylated polyethyleneimine according to claim 1, wherein the degree of quaternization of the nitrogen atoms present in the polyethyleneimine backbone lies in the range of from 70% to 90%.

4. The ethoxylated polyethyleneimine according to claim 1, wherein the polyethyleneimine backbone has a weight average molecular weight of from 400 to 10000 g/mol.

5. A composition comprising ethoxylated polyalkyleneimine polymer according to claim 1, wherein the composition is utilized in chemical technical applications, car wash, cosmetics, paper and cardboard manufacturing, leather and textile industry.

* * * * *